US006311779B2

(12) United States Patent
McSheffrey et al.

(10) Patent No.: US 6,311,779 B2
(45) **Date of Patent: *Nov. 6, 2001**

(54) SIGNALLING FIRE EXTINGUISHER ASSEMBLY

(75) Inventors: Brendan T. McSheffrey; John J. McSheffrey; Michael R. Levenson, all of Hingham, MA (US)

(73) Assignee: Mija Industries, Inc., Rockland, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/742,733

(22) Filed: Dec. 20, 2000

Related U.S. Application Data

(63) Continuation of application No. 09/212,121, filed on Dec. 15, 1998, which is a continuation of application No. 08/879,445, filed on Jun. 20, 1997, now Pat. No. 5,848,651, which is a continuation-in-part of application No. PCT/US97/01025, filed on Jan. 23, 1997, now abandoned, and a continuation-in-part of application No. 08/590,411, filed on Jan. 23, 1996, now Pat. No. 5,775,430.

(51) Int. Cl.[7] ..... A62C 37/36

(52) U.S. Cl. ..... 169/23; 169/51; 169/75; 340/289; 340/539; 340/568; 340/626

(58) Field of Search ..... 169/23, 30, 51, 169/75; 340/289, 531, 533, 539, 568, 626, 682

(56) References Cited

U.S. PATENT DOCUMENTS

| | | | | |
|---|---|---|---|---|
| 922,456 | | 1/1909 | Casey . | |
| 2,670,194 | | 2/1954 | Hansson . | |
| 3,145,375 | * | 8/1964 | Webb | 169/30 |
| 3,333,641 | | 8/1967 | Hansom et al. . | |
| 3,664,430 | | 5/1972 | Sitabkhan . | |
| 3,735,376 | | 5/1973 | Kerner et al. . | |
| 3,946,175 | | 3/1976 | Sitabkhan . | |
| 4,051,467 | | 9/1977 | Galvin . | |
| 4,100,537 | | 7/1978 | Carlson . | |
| 4,101,887 | | 7/1978 | Osborne . | |
| 4,143,545 | | 3/1979 | Sitabkhan . | |
| 4,289,207 | * | 9/1981 | Wernert | 169/30 |
| 4,418,336 | * | 11/1983 | Taylor | 169/51 |
| 4,419,658 | | 12/1983 | Jarosz et al. . | |
| 4,531,114 | | 7/1985 | Jarosz et al. . | |
| 4,548,274 | | 10/1985 | Simpson . | |
| 4,613,851 | * | 9/1986 | Hines | 340/626 |
| 4,697,643 | * | 10/1987 | Sassier | 169/23 |
| 4,890,677 | * | 1/1990 | Scofield | 169/75 |
| 5,153,567 | | 10/1992 | Chimento . | |
| 5,357,242 | | 10/1994 | Morgano et al. . | |
| 5,460,228 | | 10/1995 | Butler . | |
| 5,486,811 | | 1/1996 | Wherle et al. . | |
| 5,578,993 | * | 11/1996 | Sitabkhan et al. | 340/626 |
| 5,775,430 | * | 7/1998 | McSheffrey | 169/30 |
| 5,848,651 | * | 12/1998 | McSheffrey et al. | 169/51 |

FOREIGN PATENT DOCUMENTS

| | | |
|---|---|---|
| 3731793 | 3/1989 | (DE) . |
| 2 340 109 | 9/1977 | (FR) . |
| 2 515 845 | 5/1983 | (FR) . |
| 2 676 931 | 12/1992 | (FR) . |
| WO 81/02484 | 9/1981 | (WO) . |

* cited by examiner

*Primary Examiner*—Kevin Shaver
*Assistant Examiner*—Dinh Q. Nguyen
(74) *Attorney, Agent, or Firm*—Fish & Richardson P.C.

(57) ABSTRACT

A portable fire extinguisher assembly includes a fire extinguisher with a tank containing fire extinguishing material, a valve for metering release of the fire extinguishing material, and a gauge displaying pressure within the tank, and a docking station in communication with the fire extinguisher. An electronic circuit in communication with the fire extinguisher and the docking station issues a signal upon detection of predetermined conditions, including at least one predetermined internal condition and at least one predetermined external condition.

8 Claims, 8 Drawing Sheets

SIGNALLING FIRE EXTINGUISHER ASSEMBLY

CROSS REFERENCE TO RELATED APPLICATIONS

This application is a continuation of U.S. application Ser. No. 09/212,121, filed Dec. 15, 1998, and now pending, which is a continuation of U.S. application Ser. No. 08/879,445, filed Jun. 20, 1997, now U.S. Pat. No. 5,848,651, issued Dec. 15, 1998, which is a continuation-in-part of U.S. application Ser. No. 08/590,411, filed Jan. 23, 1996, now U.S. Pat. No. 5,775,430, issued Jul. 7, 1998, and which is also a continuation-in-part of International Application No. PCT/US97/01025, with an International filed of Jan. 23, 1997.

BACKGROUND OF THE INVENTION

This invention relates to portable fire extinguishers, e.g. of the type for domestic, office or industrial use.

Portable fire extinguishers are provided for use in all manner of environments, typically situated in standby condition in an unobtrusive location selected for reasonably easy access in a fire emergency.

SUMMARY OF THE INVENTION

According to one aspect of the invention, a portable fire extinguisher assembly comprises a fire extinguisher, a docking station, and a fire extinguisher assembly electronic circuit. The fire extinguisher comprises a tank defining a volume containing fire extinguishing material and further defining a tank outlet, and a valve assembly mounted at the tank outlet, the valve assembly comprising: a valve housing, a valve disposed relative to the tank outlet for metering release of the fire extinguishing material from the volume, a valve trigger mounted for movement of the valve between a first position for containing the fire extinguishing material within the volume and a second position for metering release of the fire extinguishing material, and a fire extinguisher gauge disposed in communication with the volume for display of pressure condition of the fire extinguishing material within the volume. The docking station is mounted in the vicinity of and in communication with the fire extinguisher. The fire extinguisher assembly electronic circuit is disposed in communication with the fire extinguisher and the docking station and adapted to issue a signal upon detection of predetermined conditions comprising at least one predetermined internal condition and at least one predetermined external condition. The predetermined internal condition may comprise a low pressure condition within the fire extinguisher tank, with the fire extinguisher assembly electronic circuit comprising a detector of the predetermined internal condition, the detector being adapted to actuate issue of a signal upon detection of the predetermined internal condition. The predetermined external condition may comprise a signal from an external electronic circuit, with the fire extinguisher assembly electronic circuit comprising a detector of the predetermined external condition, the detector being adapted to actuate issue of a signal upon detection of the predetermined external condition. The fire extinguisher assembly electronic circuit is further adapted to issue a signal to a remote station and to receive a signal from a remote station.

Preferred embodiments of this aspect of the invention may include one or more of the following additional features. The fire extinguisher electronic circuit comprises cooperative male and female electrical/communication connection elements defined by the fire extinguisher and the docking station. Preferably, the portable fire extinguisher assembly further comprises a bracket for mounting the fire extinguisher, e.g. to a surface, the bracket positioning the fire extinguisher relative to the docking station for mating engagement of the cooperative male and female electrical/communication connection elements. The fire extinguisher electronic circuit comprises an rf antenna and rf signal means and the signal comprises an rf signal. Preferably, the fire extinguisher electronic circuit also comprises an rf signal receiver for receiving the rf signal from the remote station. Alternatively, the fire extinguisher electronic circuit comprises an electronic signal means and the signal comprises an electronic signal. Preferably, the fire extinguisher electronic circuit also comprises an electronic signal receiver for receiving the electronic signal from the remote station source. The signal comprises a visual signal and the fire extinguisher assembly electronic circuit comprising an electroluminescent light panel mounted upon a gauge face surface of the fire extinguisher gauge and adapted to issue the visual signal by illumination of a region of the gauge face surface. The gauge comprises a gauge pointer and a gauge scale, the gauge pointer being moveable relative to the gauge scale for indication of pressure, and the fire extinguisher electronic circuit comprises the gauge pointer and a contact disposed in a region selected for interengagement of the contact and the gauge pointer as the tank approaches the predetermined low pressure condition. The predetermined internal condition may comprise a high pressure condition, with the fire extinguisher electronic circuit further comprising a contact disposed in a region selected for interengagement of the contact and the gauge pointer as the tank approaches a predetermined high pressure condition. The predetermined external condition may comprise removal of the fire extinguisher from an external support bracket. The signal comprises an audio signal, e.g. a recorded instructional message. The predetermined external condition may comprise smoke, lack of light or lack of external power. The predetermined internal condition may comprise low battery power. The detector comprises a timer and the predetermined internal condition comprises lack of inspection reset.

These and other features and advantages of the invention will be apparent from the following description of a presently preferred embodiment, and from the claims.

DESCRIPTION OF THE PREFERRED EMBODIMENTS

Figure 1:
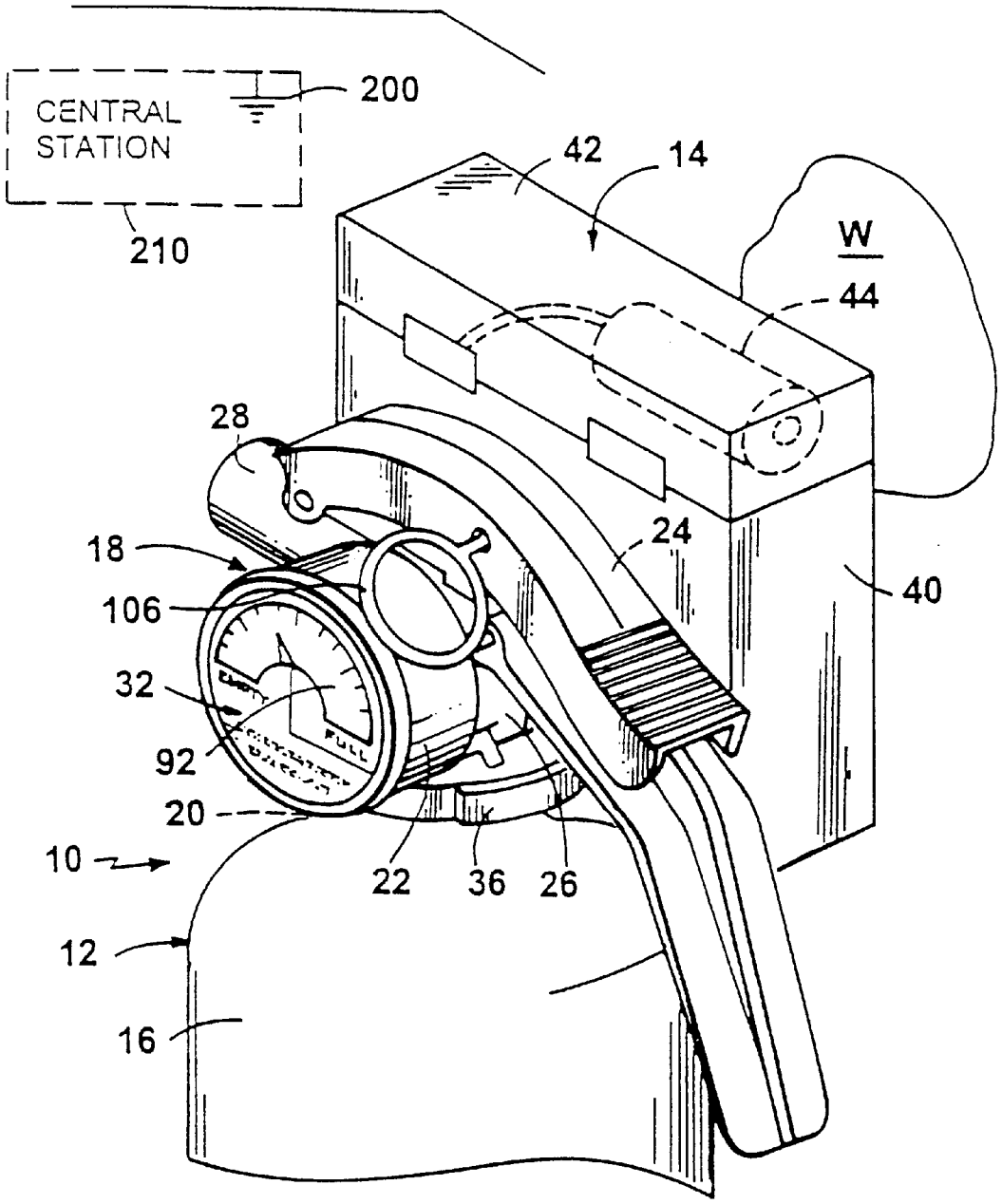
FIG. 1 is a perspective view of a signalling fire extinguisher assembly of the invention.
Figure 2:
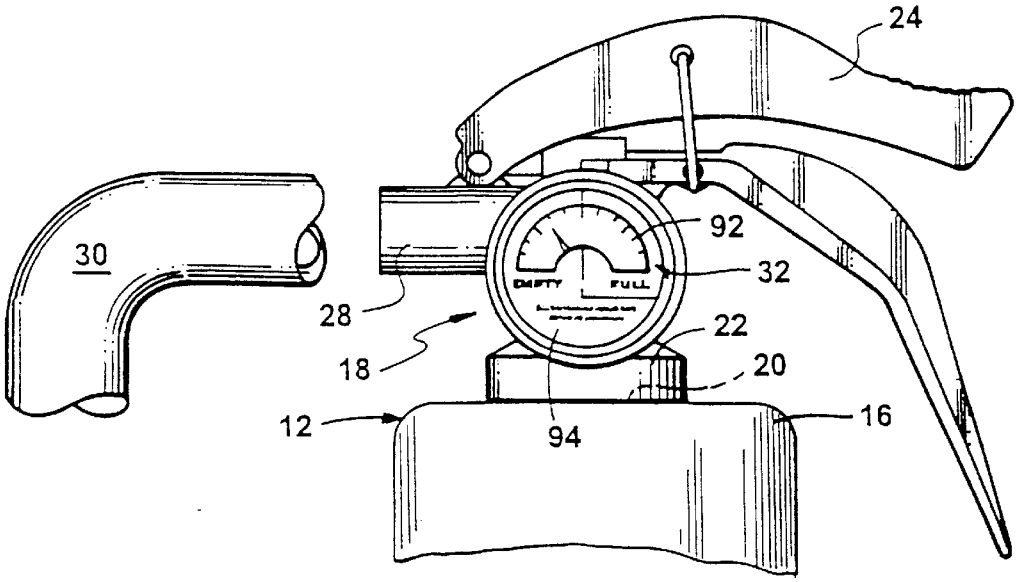
FIG. 2 is a front elevational view of the signalling fire extinguisher of the signalling fire extinguisher assembly FIG. 1.
Figure 3:
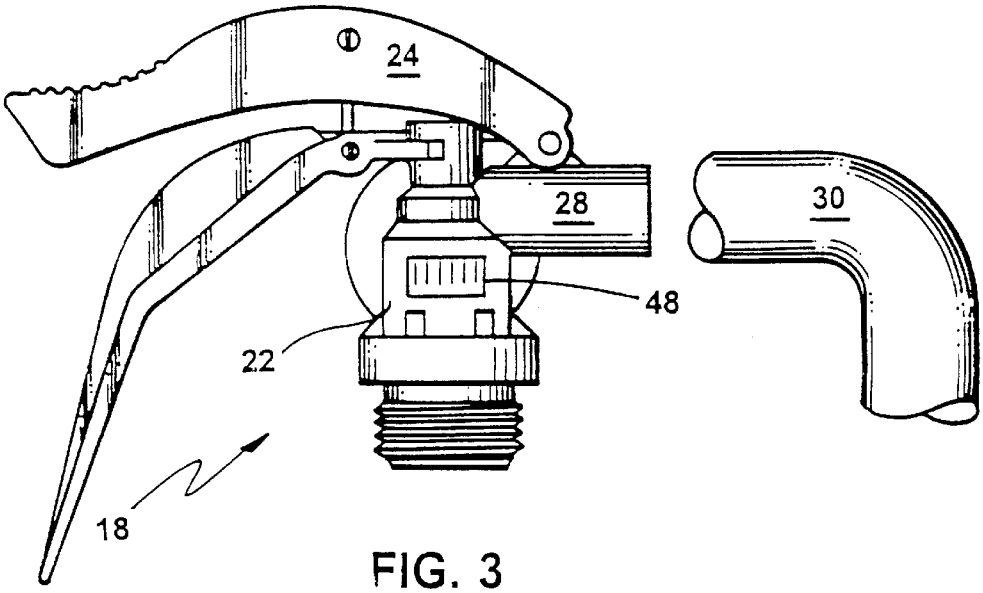
FIG. 3 is a rear elevational view of the fire extinguisher valve assembly of the signalling fire extinguisher of FIG. 2.
Figure 4:
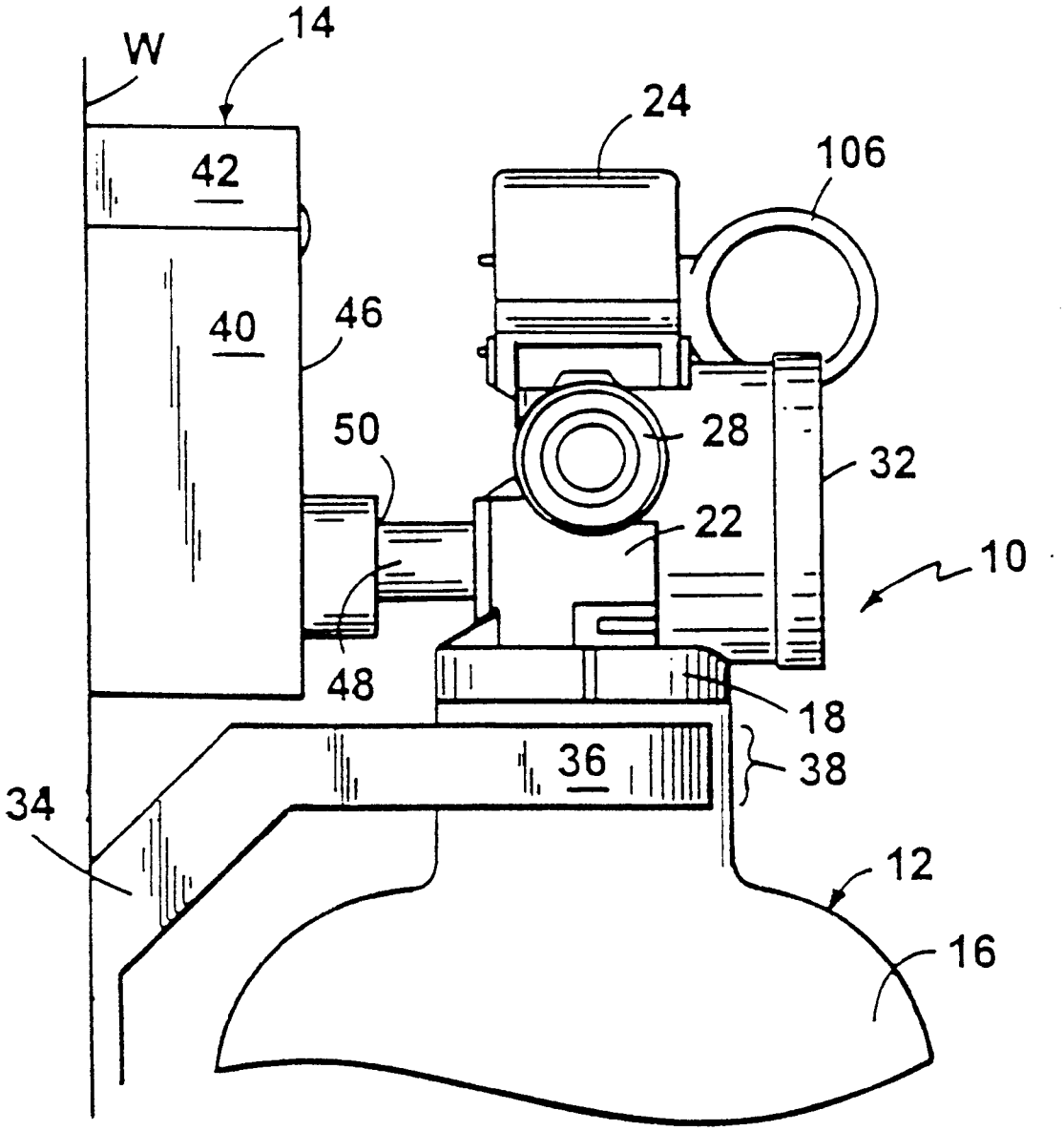
FIG. 4 is a side elevational view of the signalling fire extinguisher assembly of FIG. 1.
Figure 5:
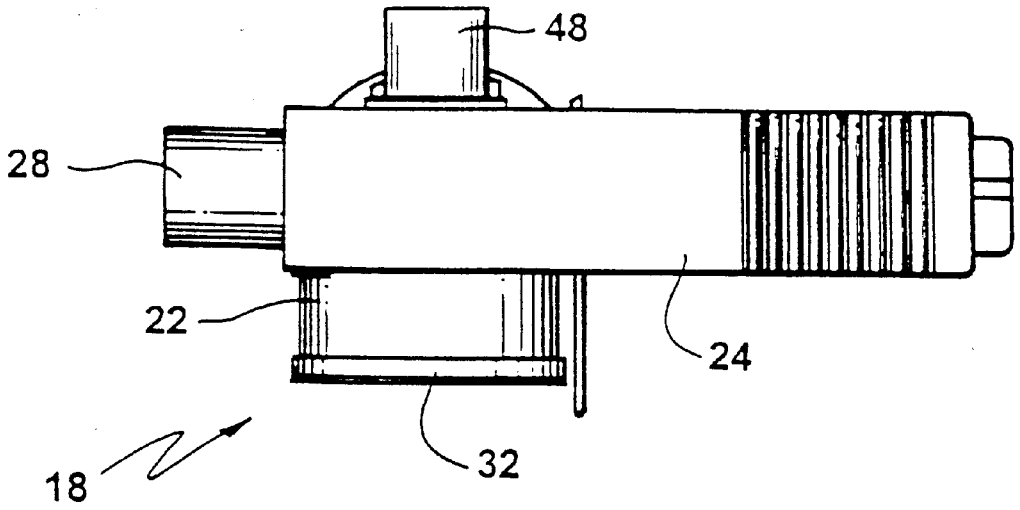
FIG. 5 is a top plan view of the fire extinguisher valve assembly of FIG. 3.

Referring to FIGS. 1–5, a portable fire extinguisher assembly 10 of the invention includes a fire extinguisher 12 and a fire extinguisher docking station 14.

The fire extinguisher 12 includes a fire extinguisher tank 16 containing a fire extinguishing material, e.g. water, dry chemical or gas, and a fire extinguisher valve assembly 18 (e.g. as provided by MIJA Industries Inc., of Plymouth, Mass.) mounted to releasably secure a tank opening 20. The valve assembly includes a body 22, e.g. an integral body formed or molded plastic, a trigger mechanism 24 for opening a valve 26 for release of fire extinguishing material, typically through a nozzle 28 (and, optionally, hose 30, FIG. 2) provided to direct and released material in a desired direction, e.g. at the base of a flame. The valve assembly further includes a gauge 32 (e.g. a Bourdon coiled tubing gauge of a type also manufactured by MIJA Industries Inc.) to provide indication of the status of the fire extinguishing material within the fire extinguisher tank 16. Extending from the rear surface of the valve body 22 is a male hard pin electrical connector element 48 for electrical and communication connection between the fire extinguisher 12 and the docking station 14, as will be described below.

The fire extinguisher is removably mounted on a wall hanger or bracket 34 (FIG. 4), fixedly secured to a wall, W, or other surface. The bracket has a pair of opposed arms 36 that releasably engage about the neck region 38 of the fire extinguisher tank 16, generally below the valve body 22.

Fixedly mounted to the wall, W, at a predetermined position generally spaced above the bracket 34, is the docking station 14. The docking station consists of a housing 40 with a hinged cover 42. Disposed within the docking station housing are elements of electronic and communication circuitry, as described more fully below, and a power supply, e.g. a battery 44 (FIG. 1). The face surface 46 of the housing defines a female socket 50 for electrical and communication connection between the docking station 14 and the fire extinguisher 12, as will be described below.

The fire extinguisher 12 and docking station 14 are positioned for contact closure between the male connection element 48 and the female connection socket 50 by snap fit engagement of the neck region 38 of the fire extinguisher tank 16 within the opposed arms 36 of the mounting bracket 34.

Figure 9:
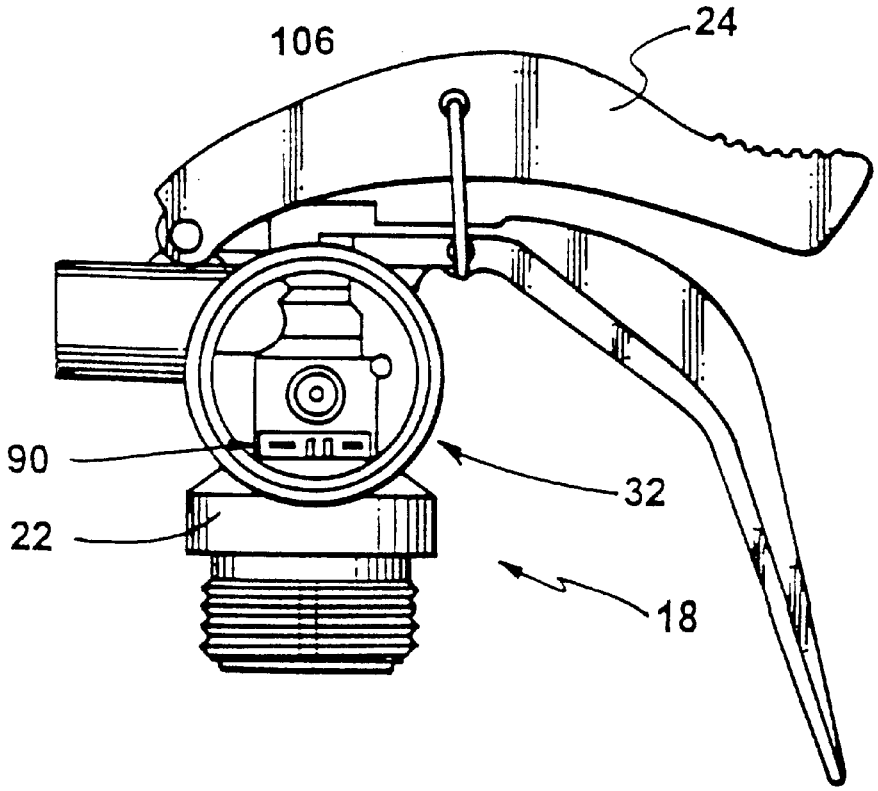
FIG. 9 is a front elevational view of another embodiment of a fire extinguisher valve assembly, similar to FIG. 2, the fire extinguisher valve assembly housing being shown with the gauge removed to reveal electronic circuit disposed therewithin.
Figure 6:
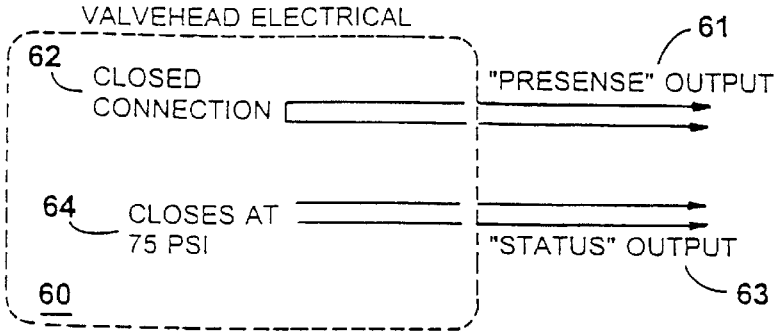
FIG. 6 is a block diagram of the fire extinguisher valve assembly electrical circuitry for one embodiment of a signalling fire extinguisher assembly of the invention.
Figure 7:
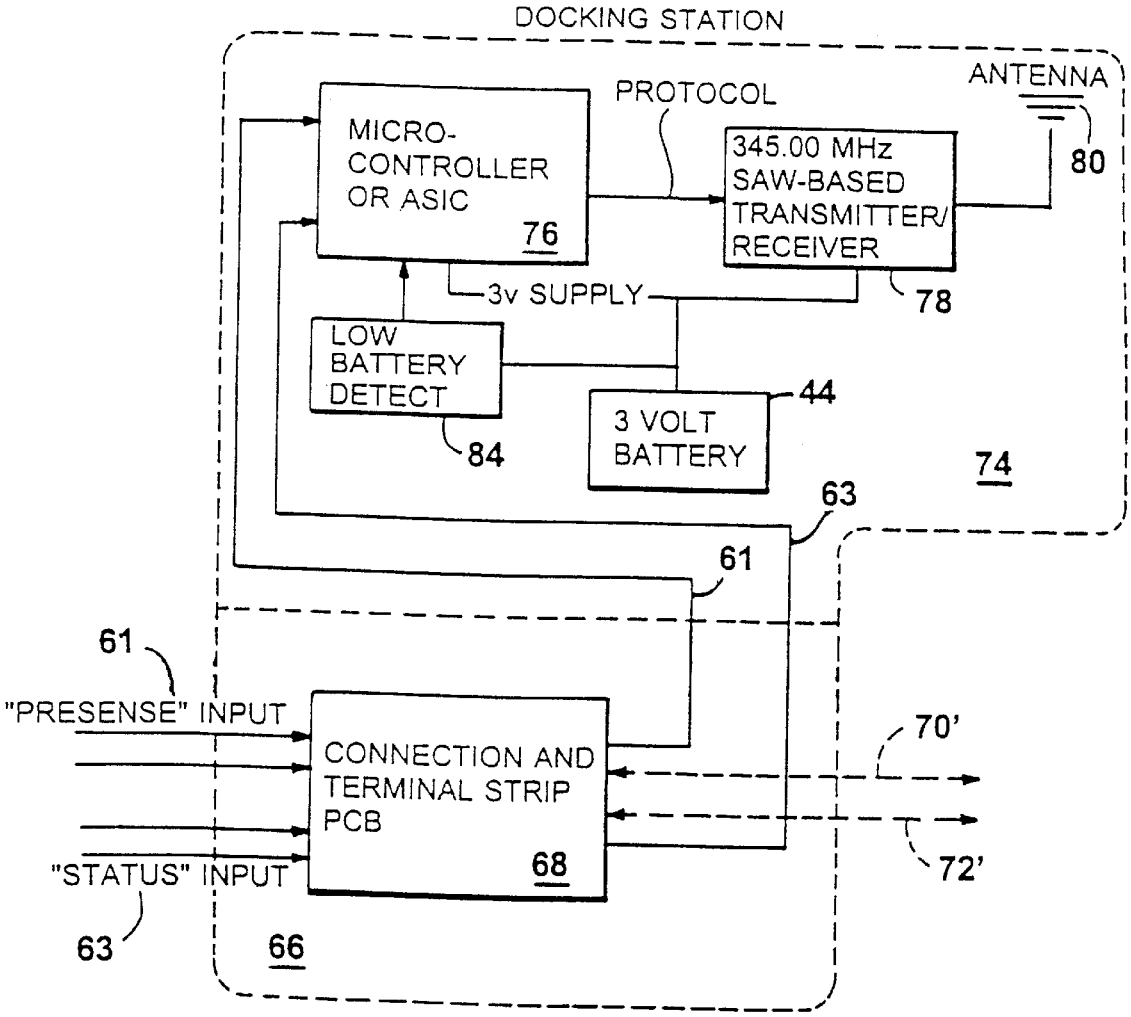
FIG. 7 is a block diagram of fire extinguisher docking station electrical circuitry for one embodiment of a signalling fire extinguisher assembly of the invention.

Referring now to FIGS. 6 and 7, the fire extinguisher valve assembly 18 contains electrical and communication circuitry 60 for issuing signals to the docking station 14. For example, in the preferred embodiment, the circuitry 60 issues a signal 61 for a predetermined external condition, i.e. non-presence of the fire extinguisher, when the fire extinguisher is removed from the bracket arms 36, thereby disengaging the male connector element 48 of the fire extinguisher 12 from the female socket 50 of the docking station 14, and disrupting the closed connection 62. The circuitry 60 also issues a signal 63 for a predetermined internal condition, i.e. existence of a low pressure condition in the fire extinguisher tank, e.g as described below with respect to FIG. 9, thereby opening the connection 64.

According to one embodiment (FIG. 7), the signals 61, 63 are communicated via the electrical/communication connection of the male connector element 48 of the fire extinguisher 12 with the female socket 50 of the docking station 14 to electrical/communication circuitry 66 within docking station 14. The signals indicating the presence of the fire extinguisher and that pressure in the fire extinguisher tank is above the predetermined minimum level are received by a connection and termination strip process control board ("PCB") 68 and communicated to RF communication electrical circuitry 74 within the docking station 14. The signals are received by a microcontroller or ASIC 76 and transmitted via a 345.00 MHz SAW-based transmitter and receiver 78 and antennae 80 to a remote RF monitoring system receiver/transmitter (not shown), e.g. at a remote central station 210 (FIG. 1). The electrical circuitry 74 also includes the power supply, e.g. battery 44, for powering the microcontroller 76 and transmitter 78, and also a low battery detector 84.

Figure 8:
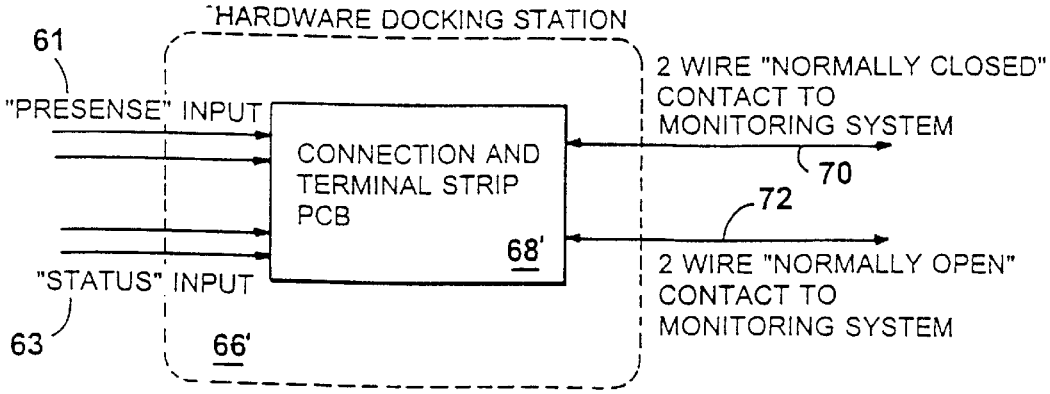
FIG. 8 is a block diagram of fire extinguisher docking station electrical circuitry for another embodiment of a signaling fire extinguisher assembly of the invention.

In another embodiment (FIG. 8), the signals 61, 63 received by a connection and termination strip process control board ("PCB") 68' of electrical/communication circuitry 66' are transmitted via hardwire connections 70, 72 to a remote central station 210 (FIG. 1). In this embodiment, connection 70 is a two wire connection in normally closed state, signalling the presence of the fire extinguisher, and connection 71 is also a two wire connection, but in normally open state, signalling that pressure in the fire extinguisher tank is above the predetermined minimum level.

It is contemplated that, in other embodiments, signals 61, 63 may be communicated, e.g. simultaneously, via both hardwire (e.g., hardwire connections 70', 72' shown in dashed line in FIG. 7) and RF (or other) communication circuitry to a remote central or other monitoring station, e.g., central station 210 (FIG. 1).

In operation of a fire extinguisher assembly 10 of the invention, the fire extinguisher 12 is releasably mounted to bracket 34 fixedly secured to wall, W (or other surface), the bracket having a pair of opposed arms 36 that releasably engage about the neck region 38 of the fire extinguisher tank 16, generally below the valve assembly body 22. As positioned by snap fit of the extinguisher into the arms of the bracket, the male connection element 48 at the rear of the valve assembly 18 of the fire extinguisher 12 is engaged in electrical and communication connection with the female socket 50 of the docking station housing 14.

The docking station 14 contains a circuit board programmed with the protocols for certain alarms or signals relating to predetermined internal and external conditions, and a battery 44 for power.

In the preferred embodiment, when the contents of the fire extinguisher tank 16 reach a predetermined low pressure point, the circuit 64 closes and signal 63 is issued, e.g. for communication to a central station. If the fire extinguisher 12 is removed, the circuit 62 is opened and signal 61 is issued and communicated to a central station. The central station may also send signals to the fire extinguisher assembly 10 to periodically check its status for internal and external conditions, e.g. low pressure and presence.

Other embodiments are within the following claims. For example, in some instances, an electronic circuit 88 is contained on a circuit board 90 (FIG. 9), mounted to the fire extinguisher valve assembly 18, beneath gauge 32, and powered, e.g., by battery 44 disposed within the docking station, or within a compartment (not shown) defined by the fire extinguisher valve body 22.

As in the embodiment shown, the circuit 88 may optionally further include an electroluminescent light panel 92 mounted upon the face 94 of the valve gauge 32. (The electroluminescent light panel 92 mounted to a gauge face 94 is shown also in FIGS. 1 and 2.)

Figure 10:
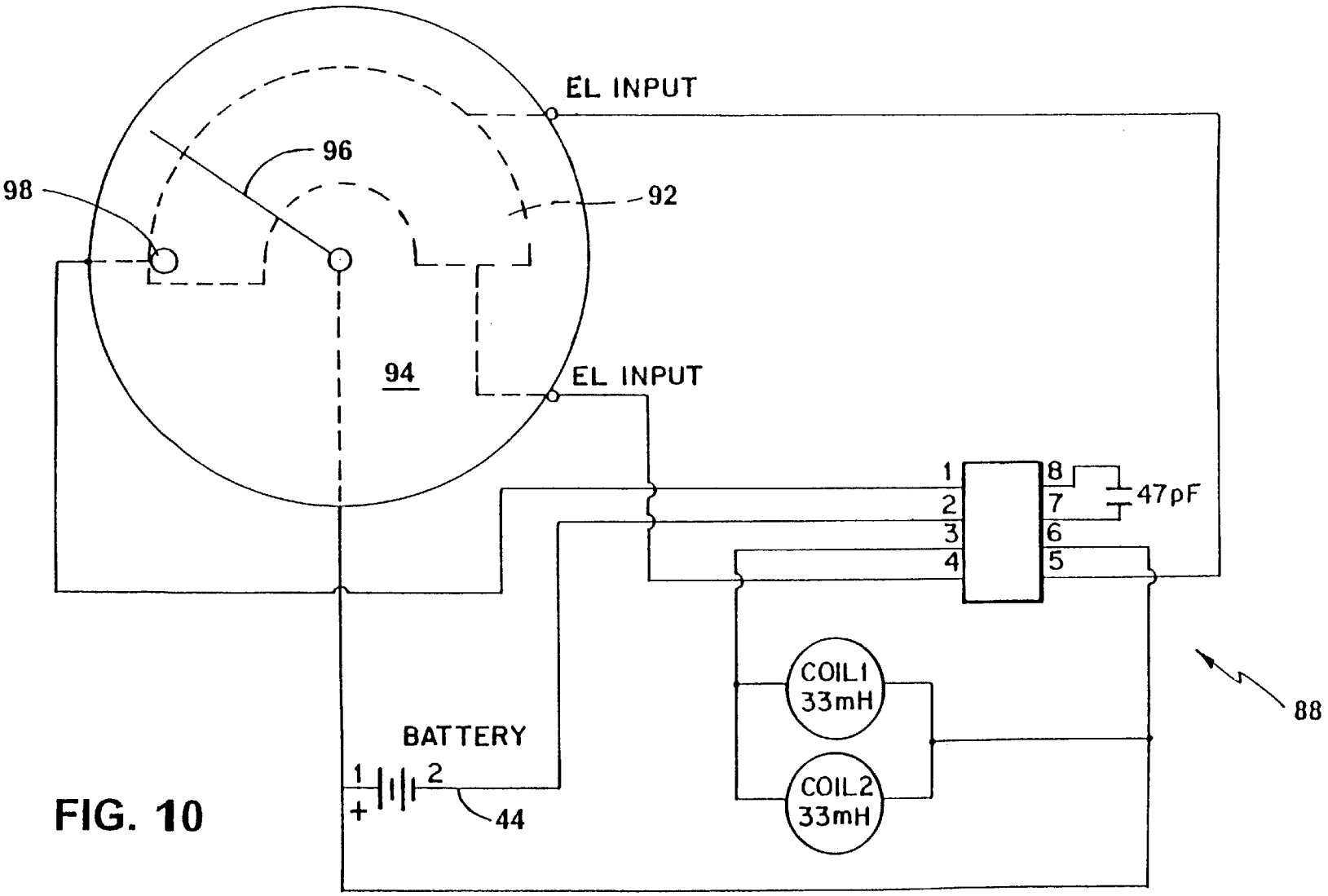
FIG. 10 is a circuit diagram of an electronic circuit for a signalling fire extinguisher assembly of the invention.

Referring also to FIG. 10, in some embodiments, the electronic circuit 88 includes the valve gauge pointer 96 and a contact 98 located in a region upon the gauge face 94 selected for interengagement of the contact and the gauge pointer, e.g. when the contents of the tank are at a low pressure condition. Interengagement of the gauge pointer and contact may optionally complete the circuit to illuminate the light panel 92, thereby to generate a visual signal to passersby, warning of the low pressure condition of the fire extinguisher.

Figure 11:
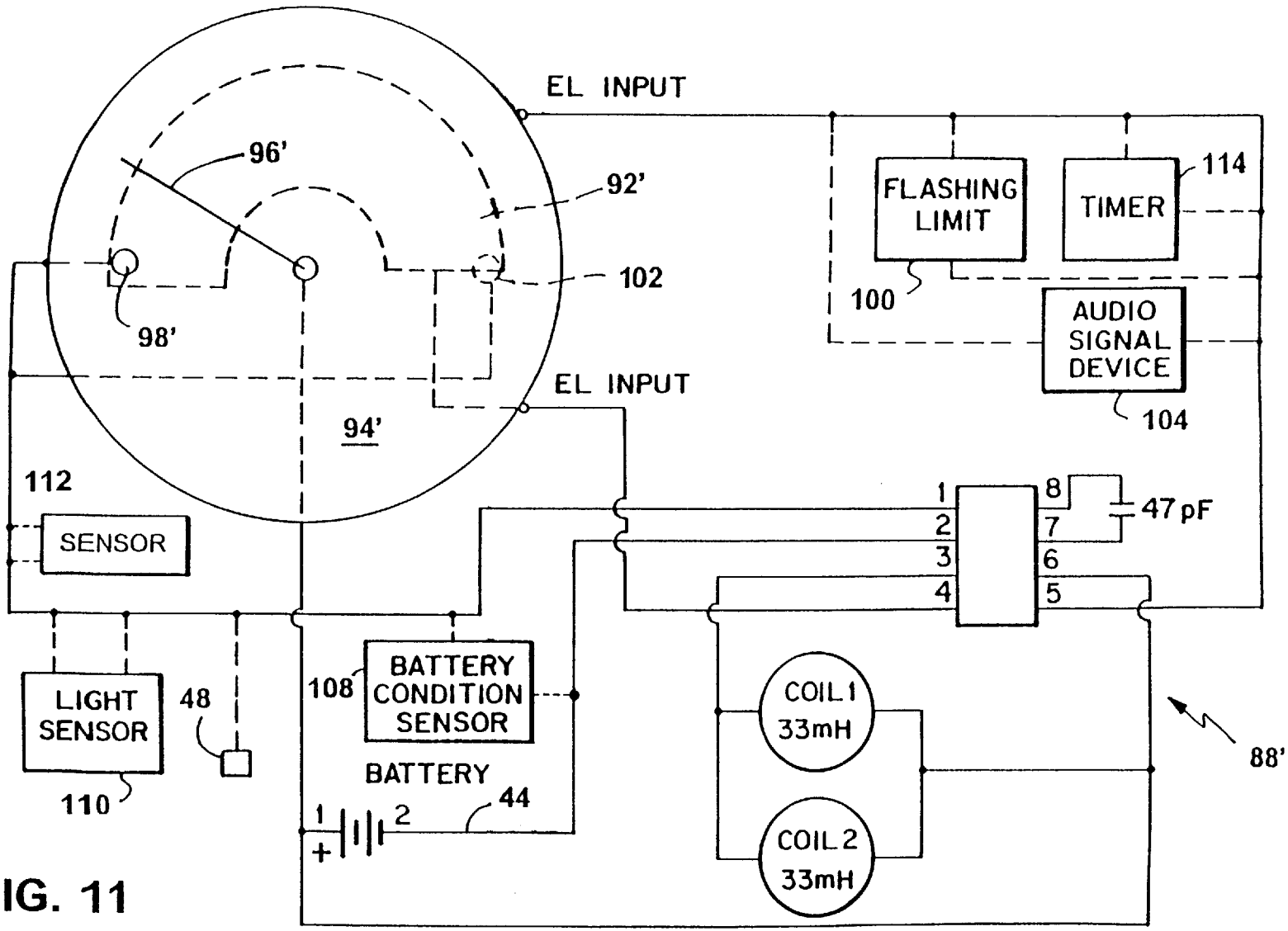
FIG. 11 is a similar circuit diagram of an electronic circuit for a signalling fire extinguisher assembly of the invention.

Also, referring to FIG. 11, in some embodiments, an electronic circuit 88' additionally includes a flashing unit 100 for intermittent illumination of the light panel, thereby to better attract the attention of passersby, and also to conserve battery life.

The electronic circuit 88' additionally or instead may, in some embodiments, include a contact 102 located in a region selected for interengagement of the contact 102 and the gauge pointer 96 when the contents of the tank 16 are at a high or overcharged pressure condition.

The electronic circuit 88' may also include an audio signalling device 104, e.g. as part of the docking station, for emitting, e.g., a beeping sound, instead of or in addition to the visual signal. The audio signal device may be triggered when the fire extinguisher is placed in use, e.g., upon removal of the pull pin 106 (FIG. 1) securing the trigger thereby to trip a sensor. The audio signal may consist of a recorded information message, e.g. instructions for use of the fire extinguisher including the type of fire for which use is appropriate, e.g. papers, electrical, liquid, all types.

The electronic circuit 88' may also include a battery condition sensor 108 to actuate a visual and/or audio signal, e.g. at the central station, when a low battery condition is detected.

The electronic circuit 88' may also include a light sensor 110, e.g. of ambient light conditions, to actuate illumination of the light panel 92' in low or no light conditions, e.g. to signal the location of the extinguisher at night or upon loss of power to external lighting.

The electronic circuit 88' may also include a sensor 112 adapted to sense other local conditions, e.g. smoke or fire, to actuate illumination of the light panel 92' and/or audio signal device 104 when smoke or other indications of a fire are sensed, e.g. to signal the location of the extinguisher when visibility is low.

The electronic circuit 88' may include a timer 114 set to actuate the visual and/or the audio signal after a predetermined period of time, e.g. the recommended period between inspections, unless the timer is reset.

The electronic circuit 88' may be responsive to a signal from an external source, e.g. a system of smoke detectors, a fire extinguisher or suppression system, or the like, to actuate the visual and/or the audio signal.

The electronic circuit 88' may also include an encoded identification specific to each fire extinguisher for receiving and dispatching signals or messages, e.g. of extinguisher condition or local status, via the electrical/communication connection with the docking station and/or the internal rf antenna, identifiable as relating to that extinguisher, to a central station and/or to other elements of a home or facility security system.

What is claimed is:

1. A portable pressurized equipment assembly comprising:

a tank defining an internal volume, a gauge in communication with the internal volume having an output which signals an internal condition of the tank;

a docking station mounted in a location where the tank is uses; and a signaling control circuit in communication with the gauge and the docking station, having an output carrying a tank condition signal.

2. The assembly of claim 1 wherein the internal condition signaled by the gauge output is a pressure within the internal volume.

3. The assembly of claim 2, the signaling control circuit further comprising:

a circuit having an output which signals an external condition of the tank.

4. The assembly of claim 3, the docking station further comprising:

signal processing circuits having inputs which receive the internal and external condition signals and having an output which carries the tank condition signal, the tank condition signal indicative of both the internal and external tank condition.

5. The assembly of claim 4, in communication with a remote system monitor which annunciates tank conditions, the signal processing circuits further comprising:

an RF transmitter which transmits the tank condition signal to the system monitor.

6. The assembly of claim 4, in communication with a remote system monitor which annunciates tank conditions, the signal processing circuits further comprising:

a hardwired connection between the docking station and the remote system monitor.

7. The assembly of claim 4, the signaling control circuit further comprising:

an electrical/communication connection which when connected to the signal processing circuits of the docking station indicates pressure of the tank.

8. The assembly of claim 4, the signaling control circuit further comprising:

a contact responsive to the gauge output, the contact having a state indicative of a minimum pressure within the internal volume of the tank.

* * * * *

UNITED STATES PATENT AND TRADEMARK OFFICE

CERTIFICATE OF CORRECTION

PATENT NO. : 6,311,779 B2 
DATED : November 6, 2001
INVENTOR(S) : Brendan T. McSheffrey, John J. McSheffrey and Micheal R. Levenson It is certified that error appears in the above-identified patent and that said Letters Patent is hereby corrected as shown below:

Column 6,
Line 20, delete “uses” and insert -- used --.

Signed and Sealed this

Twenty-eighth Day of September, 2004

JON W. DUDAS
*Director of the United States Patent and Trademark Office*